United States Patent [19]

Orosz et al.

[11] Patent Number: 4,909,716

[45] Date of Patent: Mar. 20, 1990

[54] SCREW STEP DRIVE INTERNAL VOLUME RATIO VARYING SYSTEM FOR HELICAL SCREW ROTARY COMPRESSOR

[75] Inventors: Joseph S. Orosz, Storrs; Donald D. Schaefer, Farmington; Anthony J. Bianco, New Britain, all of Conn.

[73] Assignee: Dunham-Bush, West Hartford, Conn.

[21] Appl. No.: 259,683

[22] Filed: Oct. 19, 1988

[51] Int. Cl.[4] ..... F04C 18/16; F04C 18/20

[52] U.S. Cl. ..... 418/201; 418/159; 417/310

[58] Field of Search ..... 417/310, 440; 418/201 A, 159

[56] References Cited

U.S. PATENT DOCUMENTS

| | | | |
|---|---|---|---|
| 3,677,664 | 7/1972 | Wycliffe et al. | 418/201 A |
| 3,874,828 | 4/1975 | Herschler | 418/201 A |
| 3,904,322 | 9/1975 | Axelsson | 418/201 A |
| 3,936,239 | 2/1976 | Shaw | 418/201 A |
| 4,222,716 | 9/1980 | Shaw . | |
| 4,281,975 | 8/1981 | Blackwell | 418/201 A |
| 4,515,540 | 5/1985 | Pillis | 418/201 A |

*Primary Examiner*—Leonard E. Smith
*Assistant Examiner*—John A. Savio, III
*Attorney, Agent, or Firm*—Sughrue, Mion, Zinn, MacPeak & Seas

[57] ABSTRACT

A large slide valve member concentrically mounts a small slide valve member or slide stop at one end thereof proximate to a helical screw rotary compressor discharge port with the small and large slide valve members movable as a unit for varying the built in volume ratio of the compressor. The small slide valve member is shiftable independently of the large slide valve member to vary the capacity of the machine. A large diameter cylinder fixedly mounted to the end of the compressor casing remote from an outlet port slidably mounts interiorly a smaller diameter cylinder fixed to the large slide valve via a spindle. The small slide valve is fixed to one end of a piston rod which extends through a bore within the large slide valve member and the spindle and terminates internally of the small diameter sliding inner cylinder and has fixed thereto a piston. Hydraulic fluid supplied to one side of the piston and removed from the other side shifts the small slide valve independent of the position of the large slide valve member. A stepping motor fixed to the outer cylinder has an output shaft fixed to an elongated ball screw mounted for rotation with its axis parallel to the concentric inner and outer cylinders and a cylindrical ball nut concentrically positioned on the ball screw, is flange connected through a slot opening within the side of the fixed outer cylinder, to the outer periphery of the inner cylinder. Bearing balls positioned between opposing screw threads of the ball screw and the ball nut move through a circulating loop such that the inner cylinder and thus the slide stop and the large slide valve member is driven bidirectionally, incremented by the stepping motor.

10 Claims, 2 Drawing Sheets

SCREW STEP DRIVE INTERNAL VOLUME RATIO VARYING SYSTEM FOR HELICAL SCREW ROTARY COMPRESSOR

BACKGROUND OF THE INVENTION

This invention relates to helical screw rotary compressors and more particularly, to a multiple slide valve assembly for selectively varying the capacity of the compressor using a first slide valve, and for varying the internal volume ratio of the screw compressor by a second slide valve integrated to the first slide valve while maintaining machine operation at full load.

Helical screw rotary compressors have incorporated means for varying the internal volume ratio of the screw compressor (variable Vi) to match the system pressure ratio by varying the location of radial porting while still keeping the machine operating at full load. This requires the re-positioning, in a controlled fashion, of a Vi slide valve without unloading of the machine by shifting a further capacity control slide valve. U.S. Pat. Re 31,379, reissued Sept. 13, 1983 and assigned to the common assignee, is one example of such a compressor.

Other U.S. Pat. Nos. directed to such a variable Vi concept known to the applicants are 2,519,913; 3,088,658; 3,088,659; 3,314,597; 4,455,131; 4,457,681; 4,597,726 4,609,329; 4,678,406; 4,610,612; 4,610,613 and 4,678,406.

Of the patents. U.S. Pat. Nos. 4,678,406 and 4,609,329 are representative of such axial flow helical screw compressors with a capacity control slide valve and a second slide valve or slide stop (variable volume ratio control member) mounted in face communication with the intermeshing rotors. In U.S. Pat. No. 4,678,406, the volume ratio is changed by stepwise movement of the slide stop, while the slide valve is shifted in an infinitely variable fashion for changing compressor capacity during compressor operation, and wherein the positions of both are varied in response to system operating parameters. With separate control of the slide stop and the capacity control slide valve in the event of interference between the movements of these members, the components are so designed that the movement of the slide stop overpowers that of the slide valve.

While the approach taken by U.S. Pat. No. 4,678,406 is laudatory and separate, dual controls of compressor capacity and variable Vi is achieved, stepwise movement of the slide stop is limited to but several steps, and the displacement of the slide valve and slide stop is effected from opposite ends of the end abutted slide valve and slide stop.

In U.S. Pat. No. 4,609,329, the variable Vi and capacity control of the compressor is again achieved by an end abutting capacity control slide valve and a further variable Vi slide valve or slide stop having faces confronting the intermeshed helical screw rotors. However to insure a compact arrangement for separate actuation of the slide valve and slide stop positioned centrally beneath laterally intersecting bores bearing intermeshed helical screw male and female rotors, is a longitudinally extending cylindrical recess which communicates with both the inlet and outlet ports at opposite ends of the intersecting laterally spaced bores. Mounted for slidable movement in that recess is a compound valve member in the form of an end abutting capacity control slide valve and a cooperating longitudinally shiftable side stop. The variable positioning of the slide valve is effected via a rod which passes through a slide valve inner bore and connects to a head proximate to the discharge side of the machine. The slide valve rod passes through the inner bore of the slide stop, with the slide stop, at its end opposite that abutting the slide valve, terminating in a head which mounts a first reciprocating piston within a cylindrical chamber facilitating the longitudinal shifting of the slide stop. The slide valve rod projects through the first piston and through a stationary end wall or end cap. A second, reciprocating piston is mounted to the end of the slide valve rod and lies within a second chamber defined by a fixed cylindrical casing. The fixed cylindrical casing slidably mounts both the first piston fixed to the slide stop and the second piston fixed to the end of slide valve rod.

Under such conditions, the compressor permits a controlled variation in its volumetric capacity simultaneously with controlling its compression ratio. The slide valve and the slide stop may be controlled to match the internal compression ratio in the compressor to the system compression ratio as the volumetric capacity is controlled, and when the slide valve and slide stop ar®moved apart, the axial space therebetween communicates with the intermeshed helical screw rotors to permit working fluid in a closed compression chamber or closed thread between the rotors at inlet pressure to remain in communication with the inlet port through a longitudinal slot within the casing proximate to faces of the slide valve and the slide stop to decrease the volume of fluid which is compressed. Thus, maximum capacity is provided with the slide valve and slide stop in abutting relation. A suitable control system is provided for moving the slide valve and slide stop in accordance with a predetermined program by sensing a number of variables from the compressor system, which signals are fed to a microcomputer, and the microcomputer output provides the desired control of the slide valve and the slide stop via its internal program. In addition, appropriate readouts or displays are effected to indicate the positions of the slide valve and the slide stop.

While the compressor of U.S. Pat. No. 4,609,329 achieves compactness, permits instantaneous external readout of separate slide stop and slide valve positions, the fineness of control to match the internal volume ratio of the screw compressor to the system pressure ratio is not of the requisite degree desired, and the exact positioning of the variable Vi slide stop via the microprocessor is not insured.

It is therefore a primary object of the present invention to provide a helical screw rotary compressor whose internal volume ratio may be readily changed to exactly match the system pressure ratio, while keeping the compressor operating at full load, in which concentric hydraulic cylinders include an internal hydraulic cylinder bearing a longitudinally movable piston which is solidly attached to a large Vi slide valve and within which is internally, mounted a smaller capacity control slide valve the assembly and which facilitates movement as an assembly of the internal cylinder and the large slide valve, within an outer cylinder, in which movement of the assembly as a whole is controlled by a stepping member through a ball screw mounted on the internal cylinder, and in which a rotary motion converted to linear scale output indicates the internal volume ratio of the machine.

DESCRIPTION OF THE PREFERRED EMBODIMENT

Figure 1:
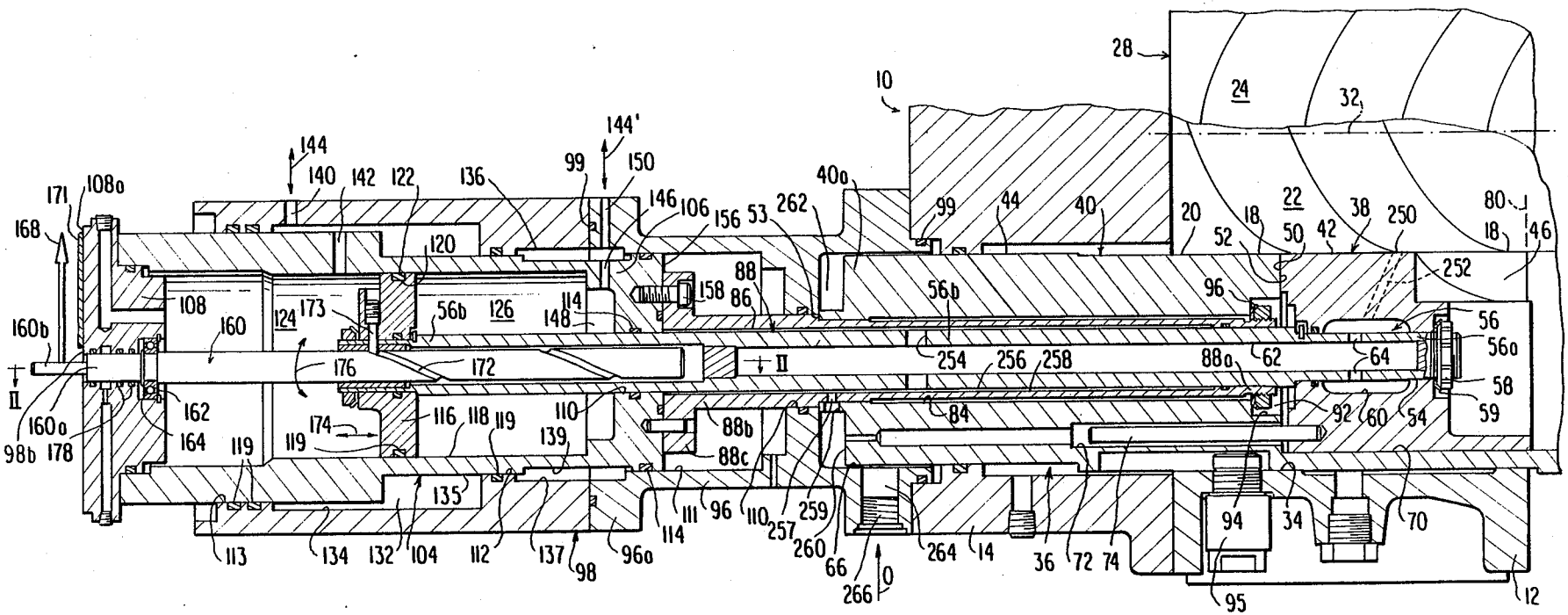
FIG. 1A is a vertical, longitudinal sectional view of a helical screw rotary compressor with ball screw effected step control, forming a preferred embodiment of the invention.
Figure 2:
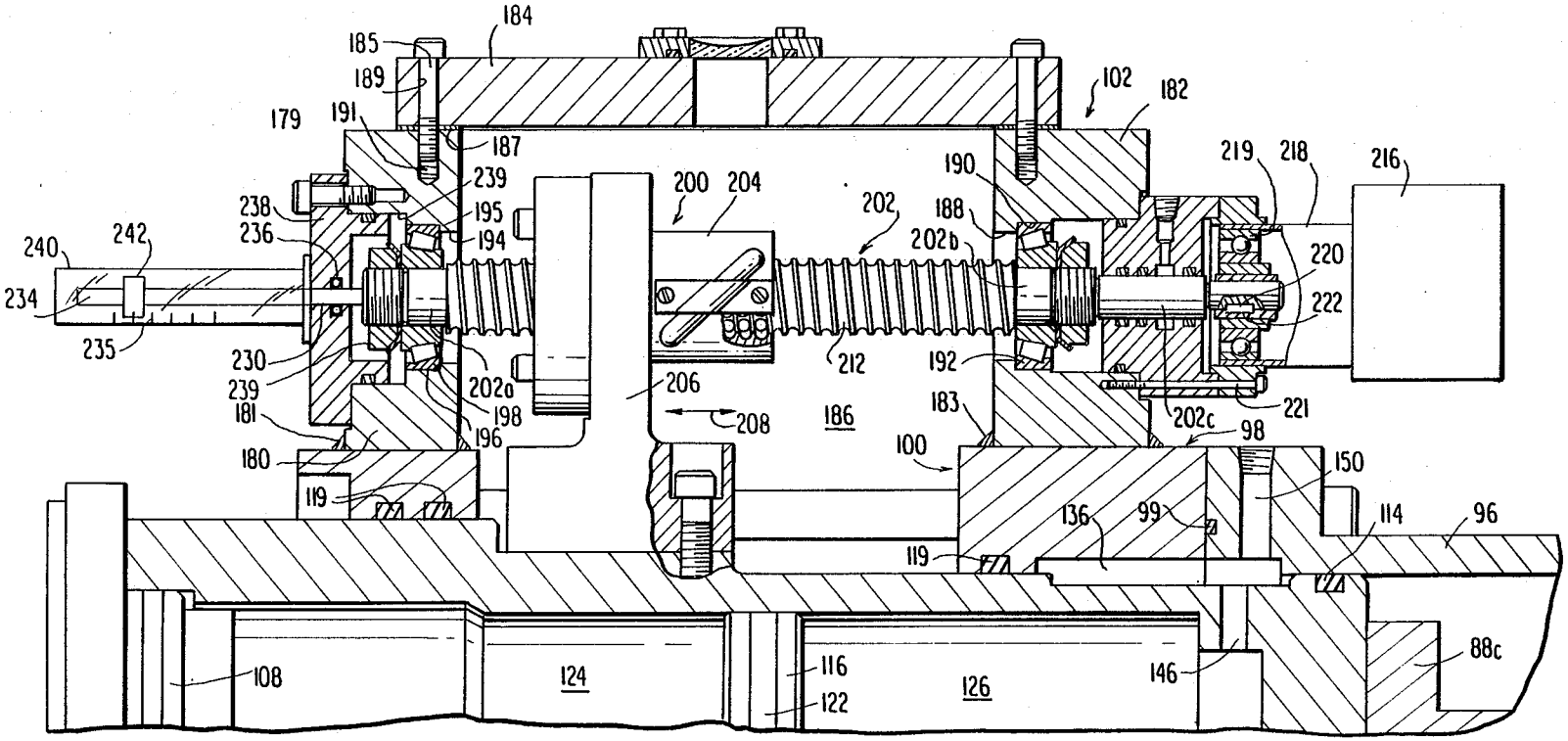
FIG. 2 is an enlarged sectional view of a portion of the compressor of FIG. 1 showing a ball screw stepping system for the Vi slide valve.

FIGS. 1 and 2 show a preferred embodiment of the present invention in which a helical screw rotary machine functioning as a compressor is indicated generally at 10 and is similar to a major degree to the compressor set forth in Reissue Pat. No. 31,379. The helical screw compressor 10, is illustrated as having a three main section compressor casing or housing, a central rotor casing 12, an inlet casing 14 and an outlet casing (not shown) in axially abutting position and being sealably coupled at their interfaces by bolts (not shown). Further, for simplicity purposes, O-ring seals conventionally employed to seal the abutting end face of the casing sections are omitted. The central rotor casing 12 is provided with laterally traversing intersecting cylindrical bores 18, 20, within which are rotatably mounted, in side by side intermeshed fashion, a pair of helical screw rotors 22, 24, respectively. The intersecting bores provide a working space for the intermeshing male and female helical screw rotors 22, 24 which are mounted for rotation about parallel axes by suitable bearings (not shown). One of the screw rotors may be rotatably driven through its mounting shaft by an electric motor (not shown) via an end plate, such details may be seen from U.S. Re. Pat. No. 31,379. The compressor 10 is provided with a inlet port (not shown) at the left end of the central rotor casing 12 and a combined axial and radial outlet port (not shown) formed by the outlet casing at the right end of the central rotor casing 12. In conventional fashion, the horizontally positioned compressor inlet port lies primarily above a horizontal plane 32 passing through the axes of the rotors, and the outlet port lies primarily below such plane. Positioned within the central rotor casing, beneath bores 18 and 20 and parallel to those bores, is a longitudinally extending cylindrical recess 34 which communicates with both the inlet port and the outlet port. Mounted for longitudinal slidable movement within recess 34 is a compound valve member or slide valve assembly indicated generally at 36 including a small, capacity control slide valve 38, to the right of, and abuttable with, a large Vi slide valve or slide stop 40. The upper face 42 of the small slide valve 38 and the upper face 44 of the slide stop 40 are in confronting relation with the outer peripheries of the intermeshed helical screw rotors 22, 24 within the central rotor casing 12.

The small slide valve 38, at its right end is provided with a recess or open potion 46 on its upper side, forming a radial portion of the outlet port. The left end 50 of the small slide valve 38 is shown as vertical and flat and abuts the flat, vertical right end 52 of the slide stop 40 in order that the abutting slide valve and slide stop will seal the recess 34 from bores 10 and 20 bearing the helical screw rotors when in the position shown in FIG. 1. The small slide valve 38 is provided with a bore 54 through which projects the right end of a hollow piston rod 56, with the end of the rod 56*a* being fixedly mounted to the small slide valve via a nut 58, backed by a washer 59. A hollow, radially enlarged chamber 60 is formed within the small slide valve, and the chamber 60 communicates with the interior bore 62 of rod 56 via a plurality of radial ports 64. The large slide valve 40 is of semi-cylindrical form and extends the full length of the recess 34 within the central rotor casing 12 and being of a length in excess of the length of the central rotor casing, such that a left end 40*a* of the large slide valve 40 is received within a recess 66 within the inlet casing 14, while an opposite right end 40*b* projects interiorly of one compressor outlet passage (not shown) within outlet casing (not shown). Further, the large slide valve 40 is provided with a cylindrical cavity or recess 70 over a major extent of its length, at the right end thereof, within which is, concentrically slidably positioned, the small slide valve 38.

One or more, stepped longitudinal holes 72 are drilled or otherwise formed within the large slide valve 40, each of which slidably receives a cylindrical rod 74 fixedly cantilever mounted outwardly from the left end face 50 of the small slide valve 35 aligned with and slidably received within the holes 72 of the large slide valve 40, so that during longitudinal movement of the small slide valve relative to the large slide valve, the rod 74 passing through the hole 72 within the large slide valve guides the small slide valve in such movement. As may be appreciated from the prior art discussed above including U.S. Pat. No. 4,609,329, in order to control the capacity of the screw compressor, and thus to load or unload the compressor, the small slide valve 38 is shifted from its leftmost position shown in FIG. 1B, at a position remote from the outlet port 30 to a rightward position proximate the outlet port, and thus from compressor full load position to full unload position depending upon demand. Such action involves the physical linear displacement of the small slide valve 38 effected through hollow rod 56.

In order to change the volumetric ratio of the machine, the large slide valve 40 housing the small slide valve 38 and the small slide valve 38, as a unit, is driven from left to right from the position shown in FIG. 1, where the internal volume ratio is the smallest as for instance 2.2 Vi: at a position, as depicted by vertical line 80 remote from outlet port 30 to a rightward position proximate to the outlet port. At the second position, the internal Vi of the exemplary compressor changes to 5.5. Of course, this action must be independent of the ability for the small slide valve controlling the capacity of the machine to be suitably, separately adjusted.

In order to permit this action, the large slide valve 40 is provided with a relatively large axial bore 84, which is somewhat larger in diameter than the outer diameter of the radially enlarged portion 56*a* of hollow rod 56 which passes through the bore 84, thereby providing an annular space 86 between the outer periphery of rod section 56*b* and the bore 84 of large slide valve 40. Projecting within bore 84 of the large slide valve 40 and within the annular space 86 is a large slide valve spindle or tube, indicated generally at 88, of hollow tubular form and which is fixedly coupled at its right end 88*a* to the large slide valve by means of a lock nut 90 fitted within an annular recess 92 of the large slide valve defined by counterbore 94 within the right end face 52 of the large slide valve 40.

Fixedly mounted to the inlet casing 14, to the left of that member, is an intermediate casing section 96, through the center of which, extends concentrically both spindle 88 and the hollow, small slide valve piston rod 56. In turn, a large diameter, fixed outer hydraulic cylinder, indicated generally at 98, is coaxially fixedly mounted to the left end of the intermediate housing 96.

The outer hydraulic cylinder 98 includes a longitudinal slot 100, FIG. 2, within the bottom of the same extending over a considerable length and having fixedly and sealably mounted therein a stepping motor outer cylinder drive mechanism indicated generally at 102. The outer hydraulic cylinder 98 concentrically surrounds an inner, smaller diameter hydraulic cylinder indicated generally at 104. Inner cylinder 104 is fixedly coupled via its transverse right end wall 106, to the left end **88*b* of the large slide valve spindle 88, via screws 150. The left end of the inner hydraulic cylinder 104 is terminated by a transverse end wall 108 which seals off the interior of the inner hydraulic cylinder 104 from a space between the inner hydraulic cylinder 104 and the outer hydraulic cylinder 98. Further, the right end wall 106 of the inner hydraulic cylinder 104 is provided with an axial bore 110 sized to and slidably and sealably receiving the radially enlarged portion 56*b* a of the small slide valve piston rod 56. In the FIG. 1, the nature of fixing the intermediate casing section 96 to the outer hydraulic cylinder 98 is purposely not shown, as well as the connection between the intermediate casing section 96 and inlet casing 14. However, the drawings do show the existence of radial flanges at opposite ends of the intermediate casing 96 at the right end of the outer hydraulic cylinder 98 through which bolts (not shown) pass for bolt connecting these elements in an axially aligned array with appropriate O-ring seals 99 between the abutting faces of these members. The intermediate casing 96 is provided with an axial bore 100, and a counter bore 111 sized to the axial bore 112 of the large, fixed outer hydraulic cylinder 99. The right end wall 106 and left end wall 108 of the inner hydraulic cylinder are sized slightly less than the diameter of counterbore 111, and bore 112 to permit the inner hydraulic cylinder 104 to slide longitudinally within the outer hydraulic cylinder 98 as well as partially within bore 110 of the intermediate casing 96. O-ring seals 114 are provided, respectively between the inner hydraulic cylinder end wall 106 and the piston rod 56 and the outer periphery of the end wall 106 and the bore 112 of the large, outer hydraulic cylinder 112 and counting bore 111 of the intermediate casing 96 depending upon the longitudinal position of the inner hydraulic cylinder 104. At the left end 56*b* of piston rod 56, there is fixed to that rod a small slide valve unloader piston 116, the piston being of a diameter slightly less than the inner diameter 118 of the inner hydraulic cylinder 104. Further, the piston is provided with an annular groove 120 within its periphery carrying an O-ring seal 122 abutting the interior of the inner cylinder 104 to separate the interior of the inner hydraulic cylinder 104 into two fluid pressure sealed chambers; 124 to the left and 126 to the right, respectively of the piston 116. Further, O-ring seals 119 are provided within the inner periphery of the large, outer hydraulic cylinder 98 which contact the outer periphery of the inner hydraulic cylinder bore 112 and counter bore 113 to seal off an annular chamber 132 formed by a recess 134 within the fixed outer hydraulic cylinder 98 an a stepped recess 135 and the inner hydraulic cylinder 104. A further annular chamber 136 is formed by a recess 139 within the outer periphery of the inner hydraulic cylinder 104 and a recess 137 within the inner periphery of the outer hydraulic cylinder 98. In order to independently shift the small slide valve relative to the large slide valve or slide stop 40, irrespective of the location of the inner hydraulic cylinder 104, fluid pressure (hydraulic fluid) must be applied to one of the two chambers 124, 126** while fluid pressure is relieved from the other of these chambers.

In order to accomplish this result, radially alignable holes or passages 140 and 142 are provided within the outer hydraulic cylinder 98 and the inner hydraulic cylinder 104, respectively permitting hydraulic fluid indicated by double headed arrow 144 to enter or escape chamber 124 to the left of the small slide valve piston 116. Further, the right end wall 106 of the inner hydraulic cylinder 104 is provided with a radial passage 146 opens to an internal annular recess 148, which opens to chamber 126, provided within and opens to annular cavity 136. Additionally, a radial hole 150 is formed within flange **96*a* of the intermediate casing leading to the annular chamber 136 and which opens to the exterior of the assembly. Thus a hydraulic fluid as indicated by double headed arrow 144 may be selectively applied or removed from the chamber 126 to the right of the small slide valve piston 116 via radial passage 150 within flange 96*a* of intermediate casing 96, annular chamber 136 and hole 146 within right end wall 106 of the inner hydraulic cylinder, and annular recess 148 of that end wall. With the large slide valve spindle 88 terminating at its left end in a radially enlarged flange 88*c* which abuts end face 156 of end wall 106, the spindle 88 may be mounted via a plurality of screws 158 to the inner hydraulic cylinder 104, insuring incremental movement of the large slide valve (with the small slide valve carried thereby) by longitudinal shifting of the inner hydraulic cylinder 104**.

The compressor 10 is provided with a capacity control indicator of known construction and which involves a translation of the longitudinal movement of the small capacity control slide valve 38 into a rotary movement applied to a dial indicator as shown or alternatively, to a potentiometer responsive to such rotary motion to provide an electrical output signal.

Specifically, the piston rod 56 is hollow, and this permits an indicator shaft or rod 160 to be mounted at one end **160*a* for rotation about its axis, being supported by anti-friction bearing 162 fixedly positioned within counterbore 164 of the left end wall 108 of the inner hydraulic cylinder. Further, indicator shaft or rod 160 includes a reduced diameter portion 160*a* projecting axially into end wall 108. Further, a short length, further reduced diameter portion 160*b* projects outwardly of inner cylinder left en wall 108. An indicator hand 168 fixed to the reduced diameter shaft portion 160*b* and projecting radially therefrom rotates in response to rotation of shaft 160 and its angular position relative to a scale fixed to the exterior face 108*a* of end wall 108 is indicative of the capacity of the compressor and may be viewed through a window of glass plastic, (not shown-)overlying end wall 98*b* of the large hydraulic cylinder. An appropriate dial face 171 may be provided on the rear surface 108*a* of end wall 108 taking the form of a scale or the like, so that the load condition of the compressor may be visually ascertained by noting the radial position of the hand 168**.

In accordance with prior practice, the outer periphery of the shaft 160 in the area projecting internally of the hollow piston rod 56 is helically grooved at 172, while the reciprocating small slide valve piston 58 has a casing, a radially inwardly projecting cam 173 which rides within the helical groove 172. The groove 172 acts as a cam follower to rotate the shaft 160 in response to longitudinal movement of the piston 116 in either direction as per arrow 174, FIG. 1A. The shaft 160 is permitted to rotate only about its axis as indicated by arrow 176. Further, appropriate O-ring seals 178 are provided within the end wall 108 of the inner hydraulic cylinder to prevent egress of the hydraulic fluid within the chamber 124 through the left end wall 108 of the inner hydraulic cylinder 104 during operation.

A principle aspect of the present inventions resides in the mechanism for close control and a direct correlation between positioning of the large slide valve 40 and the actuator input to effect that action through the inner hydraulic cylinder 104.

In that respect drive is effected through mechanism 102, FIG. 2. The stepping motor outer cylinder drive mechanism consists of a ball nut drive actuator housing 179 mounted about the opening 100 within the large, fixed, outer hydraulic cylinder 98 formed by left and right end plates 180, 182, respectively joined together by an outer casing member 184. End wall 180 is welded at 181 to the large, outer hydraulic cylinder 98. End wall 182 is welded at 133 or integral with hydraulic cylinder 98, and the two end walls 180, 182, cylinder 98 and the outer casing 184 define a sealed chamber 186. Screws 185 pass through holes 189 in outer casing 184, a strip seal 187 and have ends threaded into taped holes 191 of end walls 180, 182. Right end wall 182 is bored at 188 and counterbored at 190, with the bore 188 mounting an anti-friction bearing 192. The left end wall 180 is provided with a bore 194, partially through the thickness of the end wall 180 from the side facing end wall 182 and is counterbored at 196, such that a shoulder 195 is formed to limit shifting of an anti-friction bearing 198 to the right. A ball screw indicated generally at 200 is mounted within chamber 186, and the ball screw 200 consists of a rotary shaft 202 having reduced diameter ends **202*a* and 202*b* sized to and mounted within the respective anti-friction bearings 198, 192 for rotation about the shaft axis, and a concentric ball nut 204. The ball nut 204 is fixed to the outer periphery of the inner hydraulic cylinder 104 via a vertical mounting block 206, the ball nut including a bore provided with helical groove (not shown) of semi-circular cross section and matching, a helical groove 212 within the outer periphery of the shaft 202. A plurality of spheres or balls (not shown) are captured within the helical grooves and between opposite ends of the ball nut 204, such that by rotation of the shaft 202, shaft rotation produces a linear movement, as per arrow 208 of the ball nut 204 and to an exact degree, a longitudinal shifting of the internal hydraulic cylinder 104. The balls move through an endless path via recirculating tube coupled to opposite ends of the ball nut 204. In order to effect that shaft rotation, either a stepping motor as at 216 as shown or other means are provided for positively driving the ball screw shaft 202. The stepping motor 216 is integrated to a gear reduction unit 218, and in turn, the output of the gear reduction unit 218 is coupled directly to a further reduced diameter portion 202*c* of the ball screw shaft 202 by way of key 220 fitted into key way 222 within that shaft portion 202*c*, supported by ball bearing 219. Alternatively, by removal of the stepping motor 216 and the gear reduction unit 218 which is mounted to end wall 182 by mounting screws 221, access to the reduced diameter shaft portion 202*c* of ball screw shaft 202 may be had. The exposed end of the shaft portion 202*c* may have coupled thereto a manually operated handle fitted to the shaft via a key way and an appropriate key, such as at 220, whereby manual shifting of the internal hydraulic cylinder 104 may be achieved through the ball screw to change the position of the large Vi slide valve or slide stop 40**, thereby changing the internal value ratio Vi, and to match the internal compression of the working fluid to the pressure of the compressed working fluid at the discharge port, and thus preventing overcompression or undercompression in the machine.

In FIG. 2, a plate 238 closing off a cavity 239 within the left end wall 180 of the ball screw drive mechanism 102 is provided with a small diameter bore 230, through which projects a threaded Vi indicator rod 234 fixed to or integral with the ball screw shaft 202. Rod 234 projects axially outwardly of plate 238 and threadably supports a small block 242. An O-ring seal 236 in plate 238 prevents loss of seal in the area of the Vi indicator rod 234. Further, the inner end of a glass or plastic cylindrical tube or cover 240, which is of a diameter slightly larger than the Vi indicator rod 234, is mounted at one end to a plate 238 fixed to end wall 180 and the outer end of rod 234 projects into and reciprocates therein. The tube or cover 240 is of transparent or translucent material and presents a view of the longitudinal position of the Vi indicator rod 234. An appropriate scale 235 may be applied to the exterior face of the cover 240 and the Vi indicator rod 234 carries a threaded block which forms an appropriate axially shiftable indicator 242 to give a visual indication of the exact momentary internal volume ratio as defined by the position of the large slide valve or slide stop 40.

The compressor is equipped with one or more oil injection ports as at 250, FIG. 1, permitting oil as per arrow 0 to be injected into a closed thread for sealing and cooling purposes during the compression of the working fluid. An oil injection port 250 is provided within the upper face 42 of the small slide valve and being formed by an oblique injection hole or passage, as shown in dotted lines at 252 and which opens internally to annular cavity 60 about the small slide valve piston rod 56. Cavity 60, in turn communicates trough radial ports 64 to the inner bore 62 of piston rod 56. In turn, bore 62, which extends some distance over the length of the piston rod 56, terminates short of inner cylinder 104. In this area, one or more radial holes or passages 254 communicate to a cavity 256 defined by an annular recess 258 within the inner periphery of the valve spindle 88. I turn, a further radial hole or passage 257 is formed within the spindle 88 which opens to the annular gap between bore 84 within the large slide valve 40 and the outer periphery of the large slide valve spindle 88. A further radial port or passage 259 communicates with an annular recess 260 within the left end face 53 of the large slide valve 40. The volume 262 defined by the recess 260 within the left end face 53 of the large slide valve or slide stop 40 communicates with an oil feed port 264 defined by a topped radial, hole 266 within the inlet casing 14 and connected to a supply of oil at or above compressor discharge pressure as indicated schematically by the arrow O, thereby facilitating the injection of oil under pressure through oil injection port 250 of the small slide valve 38, and at the same time, providing an additional feature to the variable Vi control system for compressor 10.

In that respect, in the absence of means to apply a pressure against the face of the large slide valve 40 to oppose the pressure acting on the right end of the small slide valve 38 due to the compressed gas pressure at discharge, a very heavy load is applied to the large slide valve 40. The load must be overcome in stepping the inner hydraulic cylinder 104 to the right, and thus the large slide valve 40 to change the internal volume ratio of the compressor. By using the oil O under pressure for injection into the compression process which is at or near compressor discharge pressure of the working fluid and introducing it into an annular cavity 262 on the left end face 53 of the large slide valve 40, the forces acting on the large slide valve are balanced or near balanced. In a 255 mm series helical screw rotary compressor of the type shown in the drawing, the force required to move the variable volume (Vi) large slide valve 40 may be as high as 15,000 pounds. The application of the oil pressure at supply port 264 to annular chamber 262 reduces that force to approximately 5,000 pounds. The reduction of the load acting through the inner hydraulic cylinder 104 by block 206 and the ball nut 204 on the ball screw shaft 202 through the use of pressurized oil chamber 262 permits reduction in size of the ball screw and driver (stepping motor 216); the prevention of back-driving of the system due to high load; the reduction in the bearing size of bearings 192, 193 supporting the ball screw shaft 202; and a reduction in the section thickness of the supporting castings for end walls 180, 182 and outer casing 184. As may be appreciated, the annular cavity or chamber 262 which is flooded with oil at or above discharge pressure is appropriately sealed off from the inlet housing, with an overall major reduction in size for the actuating components for changing the internal volume ratio and the ability to match that internal volume ratio of the screw compressor to the system pressure ratio.

Under conditions shown in FIG. 1, the compressor is operating at minimum internal volume ratio and at maximum volumetric capacity, with the small slide valve 38 having its left end face 50 abutting the right end face 52 of the large slide valve 40. As indicated by the vertical line 80 in that figure, the internal volume ratio of the screw compressor is at its minimum value 2.2 Vi. To change the internal volume ratio of the compressor, the inner hydraulic cylinder 104 must be shifted from its full left position as shown to a fully shifted position to the right, where the left face 48 of the small slide valve 38 moves rightward from vertical inclination line 80 to one where the compressor internal volume ratio is at a maximum value; 5.5 Vi. Under such conditions with the small slide valve 38 abutting the large slide valve 40, the compressor is acting both at full capacity and with maximum internal volume ratio. It should be appreciated under these conditions, any movement of the small slide valve 38 to the right relative to the large slide valve which houses the same is achieved by applying fluid pressure to chamber 124, to the left of piston 116, while removing fluid pressure from right side chamber 126, results in unloading of the machine and changing of the volumetric capacity. At the same time, there is actually a further change in the internal volume ratio of the screw compressor upon movement of the small slide valve 38 away from the right end of the large slide valve 40. The creation of a gap between normally abutting faces 50, 52 of these members 38. 40 permits a return of suction or inlet gas to the suction port 28 in tee machine within recess 34, prior to compression. Under these conditions, if the compressor is at its highest internal volume ratio and is fully unloaded, the slide valve travel indicator for the small slide valve 38 will still read somewhere above 0% slide valve travel, and is an indication that the Vi large slide valve 40 travel should be put at its lowest position to eliminate compression and reexpansion of tee gas due to unloading (an unnecessary waste of energy).

From the above description of the machine and its operation, it may be appreciated that the compressor control consists of two sections, one internal to the compressor and one exteriorly mounted to the compressor and interacting with the internal parts. As such, the internal system consists of the large slide valve 40 and the small slide valve 38, with both having spindle connections which allow them to be selectively and individually actuated. The large slide valve 40 rides in a bore which is machined within the rotor housing section 12 and which has clearance to move through the inlet housing 14 by way of circular recess or bore 66 within inlet casing 14. Travel may be limited by stops such as stop 95, FIG. 1, in the inlet casing 14 and the actuating system. Further, the smaller slide valve 38 rides in a cylindrical bore 70 machined within the larger slide valve 40. As a result, the small slide valve 38 adequately controls the volumetric capacity of the machine, and at full load moves in conjunction with the large slide valve 40 to jointly adjust the internal volume ratio Vi. With the large, fixed, outer hydraulic cylinder containing within it an inner hydraulic cylinder 104, that inner hydraulic cylinder may readily have piston 116 fixedly connected to the small slide valve through the hollow piston rod 56. Further, with the inner hydraulic cylinder 104 solidly attached to the large slide valve 40, the inner cylinder 104 and the large slide valve 40 move as a rigid assembly within the fixed, large hydraulic cylinder 98. The movement of this assembly is readily controlled by stepping motor 217 via a ball screw 200 having the ball nut fixedly mounted to the outer periphery of the inner hydraulic cylinder 104.

The resultant design offers significant advantages. First, there is provided a full visual indication of unloading slide valve position regardless of the large, Vi slide valve 40 position. Secondly, there exists a full indication of the internal volume ratio when the machine is at full load, keeping in mind that the internal volume ratio is compromised from the position set by the large Vi slide valve 40 as the unloading slide valve 38 moves away from Vi slide valve 40 as the machine unloads.

Thirdly, as a result of the ball screw positioning using the ball screw mechanism 200, there is a direct correlation between the Vi slide valve 38 position and the number of revolutions inputted to the screw shaft 202. This allows exact positioning of the Vi slide valve 38 by use of stepping motor 216, with control achieved through a microprocessor (not shown). This also allows the user to program the exact number of internal volume ratios desired from infinite down to 1. This number of changes in internal volume ratio can be readily changed or altered without any internal change to the machine or the components. Fourthly, the internal volume ratio stepping motor can be replaced by a hand crank connected directly to the screw shaft 202 with significant cost reduction. Fifthly, if the compressor is at its highest internal volume ratio and is fully unloaded, the slide valve travel indicator will still read somewhere above 0% slide valve travel and is an instantaneous reminder to the operator that the Vi slide valve 38 should be returned to its lowest internal volume ratio position to eliminate wasteful compression and reexpansion of the gas due to unloading as a result of movement of the unload slide valve 38 away from the abutting end face 52 of the Vi slide valve 40.

While the invention has been particularly shown and described with reference t a preferred embodiment thereof, it will be understood by those skilled in the art that the foregoing and other changes in form and details may be made therein without departing from the spirit and scope of the invention.

What is claimed is:

1. In a positive displacement helical screw rotary compressor including a casing provided with a barrel portion defined by laterally intersecting bores with coplanar axes located between axially spaced end walls, and having helical screw rotors each having grooves and mounted for rotation within respective bores with the grooves of respective rotors intermeshed, an axially extending recess, open to an inlet port and provided within the barrel portion of the casing in open communication with said parallel bores, a slide valve mounted for axial movement in the recess, the slide valve having an inner face in sealing relationship with the rotor, said slide valve having a discharge face at one end thereof remote from the end wall provided with said inlet port containing a radial discharge port opening and having a rear face at its opposite end, and a slide stop mounted for axial movement in said recess with said slide stop having an inner face in sealing relationship with the rotor, a slide stop front face engageable with the slide valve rear face to form a composite axially movable assembly operative to close the axially extending recess to the inlet port, said slide valve and said slide stop being movable axially apart to provide an opening therebetween of variable size and axial position in communication with the inlet port through said recess, first actuating means for shifting said slide valve between axially extreme positions with said slide stop front face engaged with the slide valve rear face and with the compressor at full load condition, to a position where said slide valve rear face is at a maximum remote position from said slide stop front face in a direction towards a compressor outlet port and second actuating means for axially shifting said slide stop and said slide valve as a unit with said slide stop front face and said slide valve rear face in contact with each other between positions of minimum compressor volume ratio with the discharge face of the slide valve remote from the discharge port to a second position of maximum compressor volume ratio with the discharge face of the slide valve proximate to said outlet port, the improvement wherein;

an outer cylinder is fixedly mounted to a compressor casing to the side proximate to said slide stop, coaxially with said slide stop and said slide valve, an inner cylinder is mounted concentrically within said outer cylinder for axial sliding movement therein, said slide stop is provided with an axial bore, said inner cylinder being closed at opposite ends by transverse end walls, a tubular slide stop spindle is fixedly coupled at one end to the inner cylinder end wall proximate to the slide stop and at an opposite end to the slide stop such that the slide stop is driven directly by said inner cylinder, an axial bore is provided within the end wall of said inner cylinder proximate to the slide stop and is n axial alignment with the bore through the slide stop, a slide valve piston rod projects through said aligned bores within said slide stop and said inner cylinder end wall, is fixedly coupled at one end to said slide valve and has an opposite end terminating internally within said inner cylinder, a slide valve unloader piston is fixedly mounted to said opposite end of said piston rod and is in sealed engagement with the inner surface of the inner cylinder to form sealed chambers to opposite sides of the slide valve unloader piston, means are provided for selectively supplying hydraulic fluid to one of said chambers and for removing hydraulic fluid from the other chamber to drive the slide valve unloader piston axially within said inner cylinder and to shift said slide valve between said extreme positions with said piston and inner cylinder defining said first actuating means, and low friction, mechanical direct drive means are fixedly mounted to the outer cylinder and engage said inner cylinder for axially shifting said inner cylinder relative to the outer cylinder and to thereby axially shift the slide stop and the slide valve as a unit to vary the volume ratio of the compressor.

2. The helical screw rotary compressor as claimed in claim 1, wherein said low friction direct mechanical drive means comprises a ball bearing screw drive mechanism including an elongated ball screw shaft, means for rotatably mounting the ball screw shaft on the outer cylinder with its axis parallel to the axis of the outer cylinder, a ball bearing screw thread on the outer periphery of the ball screw shaft intermediate of its ends, a cylindrical ball nut concentrically positioned about the ball screw shaft, said ball nut including a ball bearing screw thread on its inner periphery, means defining a ball bearing circulating loop within the bearing ball nut, for circulating balls over said ball bearing screw shaft on said ball bearing screw thereof, a flange is carried by said ball nut extending radially outwardly thereof, means fix said flange to the outer cylinder, and drive means are coupled to said ball screw for driving the ball screw in rotation about its axis to incrementally drive the inner cylinder and thus the slide stop bidirectionally within said recess.

3. The helical screw rotary compressor as claimed in claim 2, wherein said drive means for said low friction direct mechanical drive means further comprises a bidirectional electric drive motor fixed to the exterior of the outer cylinder and directly coupled through a gear reduction unit to said ball screw at one end thereof.

4. The helical screw rotary compressor as claimed in claim 1, wherein said slide valve includes bore and a counterbore, said piston rod projects within said slide valve bore, said counterbore forms an annular cavity about the piston rod,. a radial injection passage extends through said slide valve to the inner face thereof facing the intermeshed helical screw rotors and opens at one end to the chamber defined by the counterbore within the slide valve and at an opposite end to the intersecting cylindrical bores of said compressor casing, said piston rod includes an axial bore over an extent thereof from said slide valve counterbore into said slide stop, at least one radial passage is provided within said piston rod aligned with the slide valve counterbore, and at least one radial passage is provided within said piston rod opening to the piston rod bore at one end and to the periphery of the piston rod within said slide stop bore, and wherein said compressor includes an oil feed port opening radially through one of said outer cylinder and said compressor casing, said slide stop includes a recessed surface portion within the rear face of said slide stop opposite said front face communicating with the oil feed port, and said compressor further includes means forming an annular balancing chamber at the rear of the slide stop, passage means are carried by said slide stop for communicating said balancing chamber to the axial bore within the slide stop, and means are provided for feeding oil at a pressure generally equal to the discharge pressure of the working fluid of the compressor to said oil feed port, whereby during operation of the compressor, a hydraulic force is developed within the balancing chamber offsetting the compressor discharge pressure acting on the discharge face of the slide valve, thereby limiting the load on the low friction direct machine drive means for axially shifting the inner cylinder and the slide stop fixedly coupled thereto during change in the volumetric ratio of the compressor.

5. The helical screw rotary compressor as claimed in claim 4, wherein said slide stop spindle extends concentrically about the hollow piston rod over the length of the slide stop and is fixedly coupled at the end of the slide stop spindle facing the slide valve to the slide stop, is concentrically positioned within the bore of the slide stop and between the slide stop and the piston rod, and wherein said radial passage means communicating said balancing chamber with said axial bore within the slide stop comprises aligned radial passages extending respectively through said slide stop and said slide stop spindle, in fluid communication with each other.

6. The helical screw rotary compressor as claimed in claim 2, wherein said outer cylinder includes a longitudinal slot within the side thereof said ball screw drive mechanism comprises axially spaced end walls having aligned bores therein, sealed anti-friction bearings mounted within said aligned bores of said screw drive mechanism end walls and rotatably mounting opposite ends of the ball screw shaft, an outer casing extends between said ball screw drive mechanism end walls and encloses the volume between the end walls rotatably mounting said ball screw and said ball nut, and wherein a hole is provided within one of said ball bearing screw drive mechanism end walls parallel to the axis of the ball screw and to the side thereof, and facing said ball nut flange, an exterior threaded volume ratio indicator rod is fixedly mounted to an end of said ball screw shaft within said parallel hole and having one end projecting axially outwardly of the screw drive mechanism end wall to the exterior of the outer cylinder, and a threaded indicator blocks carried by said volume ratio indicator rod for shifting linearly upon rotation of such indicator rod indicating the axial position of the ball nut relative to the ball screw and thus, the position of the slide stop and the volumetric ratio of the compressor in response to actuation of the slide stop via said ball bearing screw drive mechanism.

7. The helical screw rotary compressor as claimed in claim 6, wherein said block has an indicator mark, and a light transverse hollow tubular cover surrounds the outwardly projecting end of the indicator rod and said rod and said cover include scale markings thereon at positions alignable with said indicator mark on said block.

8. The helical screw rotary compressor as claimed in claim 1, wherein said slide stop has an axial recess within the end thereof proximate to the outlet port of the screw compressor, said slide valve is concentrically mounted within said axial recess for independent movement from said slide stop by shifting the slide valve unloader piston within the inner cylinder with said slide valve and said slide stop movable in unison by axial movement of the inner cylinder within the outer cylinder.

9. The helical screw rotary compressor as claimed in claim 8, wherein said slide stop includes at least one guide hole therein extending parallel to the axial bore and radially outwardly thereof, and wherein said slide valve includes a cylindrical guide rod fixedly mounted thereon on the rear face thereof, parallel to the axis of said slide valve and alignable with and projecting within the at least one hole within the slide stop, whereby during independent axial shifting of the slide valve relative to the slide stop, the slide valve is guided by retraction and projection of the guide rod within the aligned hole carried by the slide stop.

10. The helical screw rotary compressor as claimed in claim 9, wherein said at least one longitudinally extending hole within the slide stop at said slide stop front face, extends the length of the slide stop and opens to said balancing chamber such that the hydraulic pressure developed by oil fed from the oil feed port to the balancing chamber acts on the end of the guide rod tending to drive the slide valve in a direction away from the slide stop, while effecting lubrication of the guide rod within the guide hole.

* * * * *